US007867018B2

(12) United States Patent
Krieg et al.

(10) Patent No.: US 7,867,018 B2
(45) Date of Patent: Jan. 11, 2011

(54) APPARATUS FOR ACCOMMODATING AND MAKING ELECTRICAL CONTACT WITH A LUMINOUS MEANS IN A SPOTLIGHT

(75) Inventors: Harald Krieg, Munich (DE); Erwin Melzner, Frasdorf (DE); Kerstin Schlegel, Stephanskirchen (DE); Thomas Dörner, Kolbermoor (DE); Anton Hundhammer, Söchtenau (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 68 days.

(21) Appl. No.: 12/085,881

(22) PCT Filed: Nov. 30, 2006

(86) PCT No.: PCT/EP2006/011736

§ 371 (c)(1),
(2), (4) Date: Jul. 22, 2008

(87) PCT Pub. No.: WO2007/062878

PCT Pub. Date: Jun. 7, 2007

(65) Prior Publication Data

US 2009/0170370 A1 Jul. 2, 2009

(30) Foreign Application Priority Data

Dec. 2, 2005 (DE) ..... 20 2005 019 369 U

(51) Int. Cl.
*H01R 3/00* (2006.01)

(52) U.S. Cl. ..... 439/489

(58) Field of Classification Search ..... 439/489, 439/490, 602, 188; 340/687; 362/657–659
See application file for complete search history.

(56) References Cited

U.S. PATENT DOCUMENTS 2,213,649 A * 9/1940 Goodwin ..... 200/302.2

(Continued)

FOREIGN PATENT DOCUMENTS

DE 296 23 442 U1 7/1998

(Continued)

OTHER PUBLICATIONS

International Search Report, dated Mar. 22, 2007, corresponding to PCT/EP2006/011736.

(Continued)

*Primary Examiner*—T C Patel
*Assistant Examiner*—Harshad C Patel
(74) *Attorney, Agent, or Firm*—Christie, Parker & Hale, LLP

(57) ABSTRACT

An apparatus for accommodating and making electrical contact with a luminous means, which contains a glass vessel, a luminous means base and contact pins for supplying power, in a spotlight, which contains a luminous means holder for accommodating the luminous means base with plug-type sockets for accommodating the contact pins of the luminous means, is provided. The luminous means holder has a device for monitoring the connection between the luminous means base and the luminous means holder. The monitoring device comprises a device for detecting the relative position of at least one part of the luminous means base in relation to the luminous means holder when the luminous means base is inserted into the luminous holder.

38 Claims, 10 Drawing Sheets

U.S. PATENT DOCUMENTS

| | | | | | |
|---|---|---|---|---|---|
| 2,774,048 | A | * | 12/1956 | Baenziger | 439/476.1 |
| 2,915,621 | A | * | 12/1959 | Garland | 362/205 |
| 3,924,914 | A | * | 12/1975 | Banner | 439/105 |
| 4,000,403 | A | * | 12/1976 | Rice | 362/370 |
| 4,118,690 | A | * | 10/1978 | Paynton | 340/656 |
| 4,723,200 | A | * | 2/1988 | Troen | 362/260 |
| 5,380,214 | A | * | 1/1995 | Ortega, Jr. | 439/253 |
| 5,814,927 | A | * | 9/1998 | Chen | 313/318.03 |
| 6,060,987 | A | * | 5/2000 | Marlia | 340/540 |
| 2005/0107033 | A1 | * | 5/2005 | Kates | 455/7 |

FOREIGN PATENT DOCUMENTS

| | | | |
|---|---|---|---|
| DE | 198 16 364 | C2 | 10/1999 |
| DE | 20 2005 011 416 | U1 | 11/2005 |
| EP | 0 586 308 | A1 | 3/1994 |
| EP | 0 822 626 | A2 | 2/1998 |
| GB | 2 072 958 | A | 10/1981 |
| JP | 09-185978 | | 7/1997 |
| JP | 09185978 | | 7/1997 |
| JP | 2000-340316 | | 12/2000 |
| JP | 2000340316 | | 12/2000 |

OTHER PUBLICATIONS

Patent Abstracts of Japan, Publication 09185978, Published Jul. 15, 1997, for Nishihama, et al.

Patent Abstracts of Japan, Publication 2000340316, Published Dec. 8, 2000, for Hirai, et al.

English translation of International Preliminary Examination Report dated Jul. 8, 2008 for PCT/EP2006/011736.

* cited by examiner

APPARATUS FOR ACCOMMODATING AND MAKING ELECTRICAL CONTACT WITH A LUMINOUS MEANS IN A SPOTLIGHT

CROSS-REFERENCE TO A RELATED APPLICATION

This application is a National Phase Patent Application of International Patent Application Number PCT/EP2006/011736, filed on Nov. 30, 2006, which claims priority of German Utility Model Application Number 20 2005 019 369.0, filed on Dec. 2, 2005.

BACKGROUND

The invention relates to an apparatus for accommodating and making electrical contact with a luminous means in a spotlight.

DE 198 16 364 C2 has disclosed a spotlight for film, studio and stage lighting and further application areas which has a spotlight housing, which is used for accommodating a luminous element, a transparent cover disk in the form of a protective disk or a lens disk and a reflector. Lights or lamps, preferably discharge lamps with a base at one end, in a vertical or horizontal installed position, i.e. in each case perpendicular to the optical axis, or in an axial installed position, i.e. in the optical axis, are used as luminous means or luminous elements.

The lamps have a gas-filled glass body with electrodes arranged therein, a lamp base, through which the feed lines are guided to the electrodes, and two or more contact pins, which are arranged at that end of the lamp base which is opposite the glass body. The contact pins are inserted into the plug-in sockets of a lampholder, which is connected to the lamp housing, so as to be connected to a voltage source, it being necessary for there to be a tight fit between the plug-type sockets and the contact pins for the high levels of lamp current which need to be transmitted.

At the same time, the contact pins for example of discharge lamps with a base at one end act as fixing means for the discharge lamp. Since with increasing lamp powers the physical size of the discharge lamps and in particular the physical length of the glass body and the lamp base also increase, the lamps with relatively high lamp powers have such a physical size that, in particular in a horizontal installed position of the discharge lamps, considerable forces are exerted on the contact pins, which, in addition to the supply of power, also act as fixing contacts.

These forces result in the contact between the contact pins and the plug-type sockets of the lampholder being impaired, which is associated with increased transfer resistance in the transmission of the lamp current, a displacement of the lamp out of the focal point of the reflector and, as a result of this, reduced luminous efficiency and with the forces being transmitted into the lamp interior, which can result in impermissible voltages and ultimately in failure of the lamp.

The disadvantages associated with the lamp being mounted exclusively via the contact pins do not only take effect in the steady-state range in terms of the physical size of the lamp, however, but in particular also in the dynamic range in the case of transport of a spotlight or its operation with jerky pivoting movements, impacts on the lamp housing and the like.

In order to be able to use a lamp housing for lamps with different lamp base diameters without replacing an accommodating device and to use the contact pins of the lamps exclusively for transmitting the lamp current, in the case of the lamp housing known from DE 198 16 364 C2 the accommodating device comprises clamping jaws, which engage around the lamp base and can be adjusted by means of the adjusting device into an opening position, in which the lamp base is released, and into a locking position, in which the lamp base is fixed. The adjusting device comprises a latch with two sloping faces, which have an identical geometric design and bear against the upper and lower clamping jaws in such a way that, when the latch is adjusted, the clamping jaws are spread radially apart.

During actuation of the adjusting device for the purpose of opening and closing the clamping jaws, at the same time opening and closing of the plug-type sockets which accommodate the contact pins of the luminous means also takes place, with the result that by simultaneously releasing the contact pins in the case of an actuation of the adjusting device for the purpose of opening and closing the clamping jaws the luminous means can be removed easily by the luminous means base being released or a luminous means can be inserted in the opening position of the lamp holding device.

In the case of spotlights with luminous means with a base at one end, the luminous means are plugged through the reflector with the front-side cover of the front side of the spotlight open and are fixedly clamped in the luminous means holder positioned behind said reflector. Only when the luminous means bears centrally and straight against the end stop of the luminous means holder can the clamping apparatus be actuated since otherwise the luminous means holder, the plug-type sockets or the luminous means base and the contact pins would be damaged by breakage, flashovers or corrosion.

With increasing power and therefore increasing physical size of the luminous means, however, there are problems associated with the correct insertion of the luminous means into the luminous means holder of the spotlight. On the one hand, the luminous means needs to be observed from the front when it is inserted into the luminous means holder in order to be able to insert the luminous means straight, i.e. with mutually aligned contact pins of the luminous means and the plug-type sockets of the luminous means holder, while on the other hand the operator needs to firmly hold and center the luminous means with one hand and operate the clamping apparatus with the other hand, and the operating elements of said clamping apparatus are usually found on the side of the spotlight housing. In this case, however, in the case of relatively high spotlight powers with correspondingly large spotlight housings the operator can no longer stand sufficiently far in front of the spotlight in order to be able to at the same time observe the straight insertion of the luminous means and operate the clamping apparatus.

A further problem consists in the fact that, on the one hand, a reflector opening is desired which is relatively favorable in optical terms for the reflection of the light emitted by the luminous means and is therefore as small as possible, but which, on the other hand, makes the visual control when inserting the luminous means into the luminous means holder more difficult since the view of the luminous means holder is impeded, in particular if the luminous means has already been partially inserted into the luminous means holder, with the result that the operator can no longer identify whether the luminous means has been inserted correctly or is skew and consequently the contact pins of the luminous means make contact with the plug-type sockets of the luminous means holder only to an insufficient extent.

A displacement of the clamping apparatus for force-fitting and/or form-fitting clamping-in of the luminous means base toward the front side of the spotlight housing would not result in any substantial improvement of the visual control during the insertion of the luminous means into the luminous means holder since the visual control would in any case be impaired by a narrow reflector opening, with the result that improved visual control would only be possible with an enlarged reflector opening, with the downside of impaired beam reflection and poorer optical properties of the spotlight.

In order to detect a correct fit of a lamp base in a lampholder, it is known from JP 09-185978 A to provide a recess in the lamp base, with a torsion spring arranged on the bottom of said recess, the ends of said torsion spring being bent upward and having engagement projections, which engage in corresponding engagement recesses in the inner wall of the lampholder. If the lamp base is inserted into the lampholder, this results in rotation of the torsion spring and, when the engagement projections engage in the engagement recesses, an acoustic signal is produced.

JP 2000-340316 A has disclosed a device for detecting an insufficient connection between a lamp base of a discharge lamp and a lamp holding device, which connection comprises a connecting cable and a fixing clamp, which can only be connected to the lampholder when the lamp base is completely connected to the lampholder.

DE 296 23 442 U1 has disclosed a lighting device with a radiator which has a base at one end, in which lighting device a connection of the radiator to a holder is ruled out if the radiator is unsuitable. For this purpose, the holder for accommodating the radiator is connected to a sensor element, which receives magnetic or optical pulses, while that part of the base which faces the holder is provided with a marking element, which emits magnetic or optical pulses, which are received by the sensor element once the marking means has been excited by excitation means such that it emits the pulses.

GB 2072958 A has disclosed a discharge lamp whose base is connected to a holder, which contains a device for producing a high voltage from an AC voltage. The holder has a recess at whose end a high-voltage contact is arranged, which is connected to a pin protruding from the base of the discharge lamp. Furthermore, contacts for preheating the cathode and contacts corresponding to a peripheral conductive collar of the lamp base are provided in the recess of the holder, with which contacts a signal applied to the contacts of the holder is short-circuited. The short-circuiting of the contacts signals the correct fit of the lamp base in the holder emitting the high voltage.

These known apparatuses for detecting the correct fit of a lamp base in a lampholder or for preventing the insertion of an unsuitable luminous means into a lampholder have a very complex configuration and require corresponding devices both on the lamp base and on the lampholder, with the result that they are only capable of functioning when the lamp base of the luminous means is provided with the corresponding detection means. The complex configuration of the detection devices also results in increased sensitivity to interference, which results in faulty detections, in particular taking into consideration the high temperatures in the region of the lamp base and the lampholder.

SUMMARY

The object of the present invention is to provide an apparatus of the type mentioned at the outset which is designed to be very simple and insensitive to external influences and interference and ensures correct insertion of a luminous means into the luminous means holder of a spotlight even in the case of high spotlight powers and poor visual conditions with at the same time simple and safe handling.

The solution according to the invention ensures, using simple means which are insensitive to external influences and interference, correct insertion of a luminous means into the luminous means holder of a spotlight even in the case of high spotlight powers and under poor visual conditions with at the same time simple and safe handling.

As a result of the continuous detection of the positioning of a luminous means base which is inserted into a luminous means holder, the correct alignment and connection between the luminous means base and the luminous means holder can be checked and if necessary corrected even before the end stop or end fit of the luminous means base in the luminous means holder is reached. Since the insertion of the luminous means base into the luminous means holder activates and actuates the monitoring device, said monitoring device can be configured in a very simple manner and such that it is insensitive to external influences, which is of particular significance for interference-free operation in particular as a result of the high temperatures in the region of the luminous means base and the luminous means holder. In addition, the monitoring device according to the invention provides the precondition for different embodiments of the monitoring device with a respectively corresponding functional principle.

The solution according to the invention is based on the consideration that the integration of a monitoring device in a spotlight does not necessitate visual control from the light-emitting front side of the spotlight, with the result that an operator does not need to maintain a minimum distance from the front side of the spotlight housing when correctly inserting the luminous means into the luminous means holder of the spotlight, but can concentrate on the insertion of the luminous means into the luminous means holder and operation of the clamping apparatus. The monitoring device signals the correct connection between the luminous means base and the luminous means holder and therefore optimum electrical contact between the contact pins and the plug-type sockets.

The monitoring device according to the invention, whilst maintaining the functional principle of detecting the relative position of at least one part of the luminous means base in relation to the luminous means holder when the luminous means base is inserted into the luminous means holder, makes a plurality of exemplary embodiments with different physical basic functions possible.

A first exemplary embodiment comprises an optical position inspection device with at least one inspection opening, which is arranged on a side wall of the spotlight housing and/or a luminous means housing in the region of the luminous means holder and is aligned with at least one opening or cutout of the luminous means holder, the opening or cutout of the luminous means holder being arranged in the contact region of the end side of the luminous means base with the luminous means holder and in particular on the front edge, in the insertion direction of the luminous means, of the luminous means holder.

In this exemplary embodiment of a position detection device in the form of an inspection opening, lateral observation of the luminous means holder and therefore the establishment of a correct connection between the luminous means base and the luminous means holder is made possible without optical visual control from the front side of the spotlight being necessary. In order to ensure a sufficiently large viewing field for checking the correct fit of the luminous means base, in this embodiment a correspondingly large opening needs to be provided in the luminous means holder or in the spotlight housing with resultant problems in terms of the shielding of undesired parasitic light, convection cooling and in terms of the protection of the spotlight against spraywater and jet-water and electrical insulation problems.

In an alternative exemplary embodiment, the optical position detection device contains two inspection openings, which are positioned opposite one another, are arranged on the side walls of the spotlight housing in the region of the luminous means holder and are aligned with mutually opposite openings or cutouts of the luminous means holder.

This exemplary embodiment makes transillumination of the luminous means holder possible via two mutually opposite openings in the luminous means holder and in the spotlight housing, with the result that lateral observation of the luminous means holder and therefore the establishment of a correct connection between the luminous means base and the luminous means holder is likewise made possible without the need for optical visual control of the front side of the spotlight, it being possible for the required cutouts or openings to be kept smaller than in the abovementioned embodiment, with the result that the problems as regards the parasitic light to be avoided, the influencing of the convection cooling, the restriction of the protection against spraywater and jet-water and as regards electrical insulation problems are reduced.

A further exemplary variant of an optical position detection device is characterized by at least one fiberoptic conductor, which is connected to one of two mutually opposite openings in the luminous means holder and to a control element, with the result that light can be supplied into the area to be observed via an opening and the light injected into the area to be observed is guided via the fiberoptic conductor to the control element or, in the case of a luminous means base which has been inserted completely into the luminous means holder, for example, the supply of light to the control element is interrupted.

Furthermore, the opening opposite the one fiberoptic conductor can also be connected to a fiberoptic conductor which supplies light to the contact region, with the result that the supply of light to the area to be observed also takes place via a fiberoptic conductor.

Exemplary, the two mutually opposite openings are arranged in the luminous means holder in the contact region of the end side of the luminous means base with the luminous means holder.

In this exemplary variant of an optical position detection device, the optical visual control by the operator is replaced by a simple optical display, in which, when the luminous means base has been correctly inserted as far as the stop of the luminous means holder, the optical display darkens and thus signals to the operator the correct fit of the luminous means base. The optical display can if required be replaced or supplemented by an electrical signal device by an optoacoustic transducer being used or added. In this variant of an optical position detection device, however, additional optical and electronic components are required.

As a result of the fact that the opening or cutout supplying light to the contact region or the fiberoptic conductor supplying light to the contact region is connected to a light-injecting opening or optical element at a favorable point on the outer side of the spotlight housing, the required light for illuminating the connection region can be injected between the luminous means base and the luminous means holder.

As an exemplary alternative, the opening or cutout supplying light to the contact region or the light-supplying fiberoptic conductor can be connected to an auxiliary lamp for illuminating or transilluminating the area to be observed in the luminous means holder, with the result that the auxiliary lamp is used to inject light into the fiberoptic conductor, which illuminates the region in question of the luminous means holder even without any external light, i.e. even when there is complete darkness, and therefore ensures optical or acoustic checking of the correct fit of the luminous means base.

As an exemplary alternative, the control element may comprise a viewing opening or viewing optical element arranged on the spotlight housing or an optoelectronic transducer which is connected to the spotlight housing and an optical and/or acoustic signal device, and the fiberoptic conductors can be in the form of glass or glass-ceramic fiberoptic conductors.

Instead of an optical position detection device, a mechanical position detection device with a mechanical sensor, which is inserted into the luminous means holder and is connected to a display device, can be provided.

This exemplary embodiment uses simple mechanical means to enable a display for checking the correct fit of a luminous means in a luminous means holder without it being necessary for the operator to be standing in front of the spotlight when inserting the luminous means. At the same time the mechanical position detection device, in particular in conjunction with a mechanical display device, ensures checking of the correct fit of the luminous means in the luminous means holder even in the case of very poor visual conditions as early as during the insertion of the luminous means base into the luminous means holder.

Exemplary, the sensor comprises a feeler, which protrudes into the luminous means holder and can be displaced when the luminous means base is inserted and is connected to an indicator lever.

In this exemplary embodiment, the correct fit of the luminous means in the luminous means holder is no longer checked merely optically by means of a visual control, but can take place by means of merely detecting the position of the indicator lever as early as during the insertion of the luminous means base into the luminous means holder, with the result that the checking of the correct fit can also take place in darkness or under very poor visual conditions. At the same time, this embodiment is characterized by its simple mechanism with high reliability.

Exemplary, the feeler is guided toward that end of the luminous means holder which is opposite the insertion opening of the luminous means holder and bears against a first lever arm of the rotatably mounted and spring-loaded indicator lever, whose second lever arm is guided through an opening of a holder mount which accommodates the luminous means holder and/or of the luminous means housing.

The second lever arm acting as the pointer is preferably longer than the first lever arm which makes contact with the feeler, as a result of which a greater deflection of the first lever arm acting as the pointer is ensured so as to improve the accuracy of the display.

In order to display the correct fit of the luminous means base in the luminous means holder, in a first embodiment the second lever arm of the indicator lever can be arranged in a molded part of the holder mount or the luminous means housing, which molded part has a marking which is correlated with the displacement of the feeler when the luminous means base is inserted into the luminous means holder. In this embodiment, the marking can comprise an end stop of a cutout, which accommodates the second lever arm of the indicator lever.

As an exemplary alternative, the marking can comprise a tab which corresponds to the contour of the end of the indicator lever and is aligned with the direction of the deflection of the indicator lever when the luminous means base is completely inserted into the luminous means holder.

In order to ensure that the luminous means base comes into contact with the feeler, that end of the feeler which protrudes into the insertion opening of the luminous means holder is designed in such a way that, when the luminous means base is inserted into the luminous means holder, it stops against part of a luminous means holder, the area of that end of the feeler which protrudes into the insertion opening of the luminous means holder being greater than the diameter of the feeler.

In a exemplary specific embodiment, the feeler has a hook-shaped or mushroom-shaped projection, which protrudes into the insertion opening of the luminous means holder and can be displaced into a cutout of the luminous means holder when the luminous means base is inserted into the luminous means holder, and is made from ceramic, glass ceramic or glass.

In a further exemplary alternative embodiment, the feeler comprises a ceramic lever, which is mounted in freely floating fashion in the luminous means housing and/or the luminous means holder and is guided in at least one cutout of the luminous means housing and/or the luminous means holder, which ceramic lever is connected to an indicator lever, which is arranged outside the luminous means housing and/or the luminous means holder.

This particularly simple embodiment is resistant to high temperatures and ensures correct operation even under extreme external conditions since no canting occurs as a result of the freely floating mounting of the ceramic lever, with the result that the ceramic lever is adjusted by the luminous means base when the luminous means is inserted and the indicator lever, which protrudes out of the luminous means holder and is connected to the ceramic lever, indicates the respective relative position of the luminous means base in relation to the luminous means holder even without any visual contact.

These features of a mechanical position detection device firstly ensure that the insulating effect of the luminous means holder is maintained and is not impaired by the leakage paths and air gaps which are necessary since that part of the mechanism of the mechanical position detection device which is in the region at risk is made from a high-temperature insulator, and secondly a large indicator lever can be used, by means of which the correct fit of the luminous means base in the luminous means holder can be indicated extremely precisely and, if necessary, can also be coupled to additional signaling devices, which indicate the correct fit reliably and reproducibly.

BRIEF DESCRIPTION OF THE DRAWINGS

The features according to the invention and the advantages of the apparatus according to the invention are illustrated and explained in more detail with reference to exemplary embodiments illustrated in the figures, in which.

DETAILED DESCRIPTION

Figure 1:
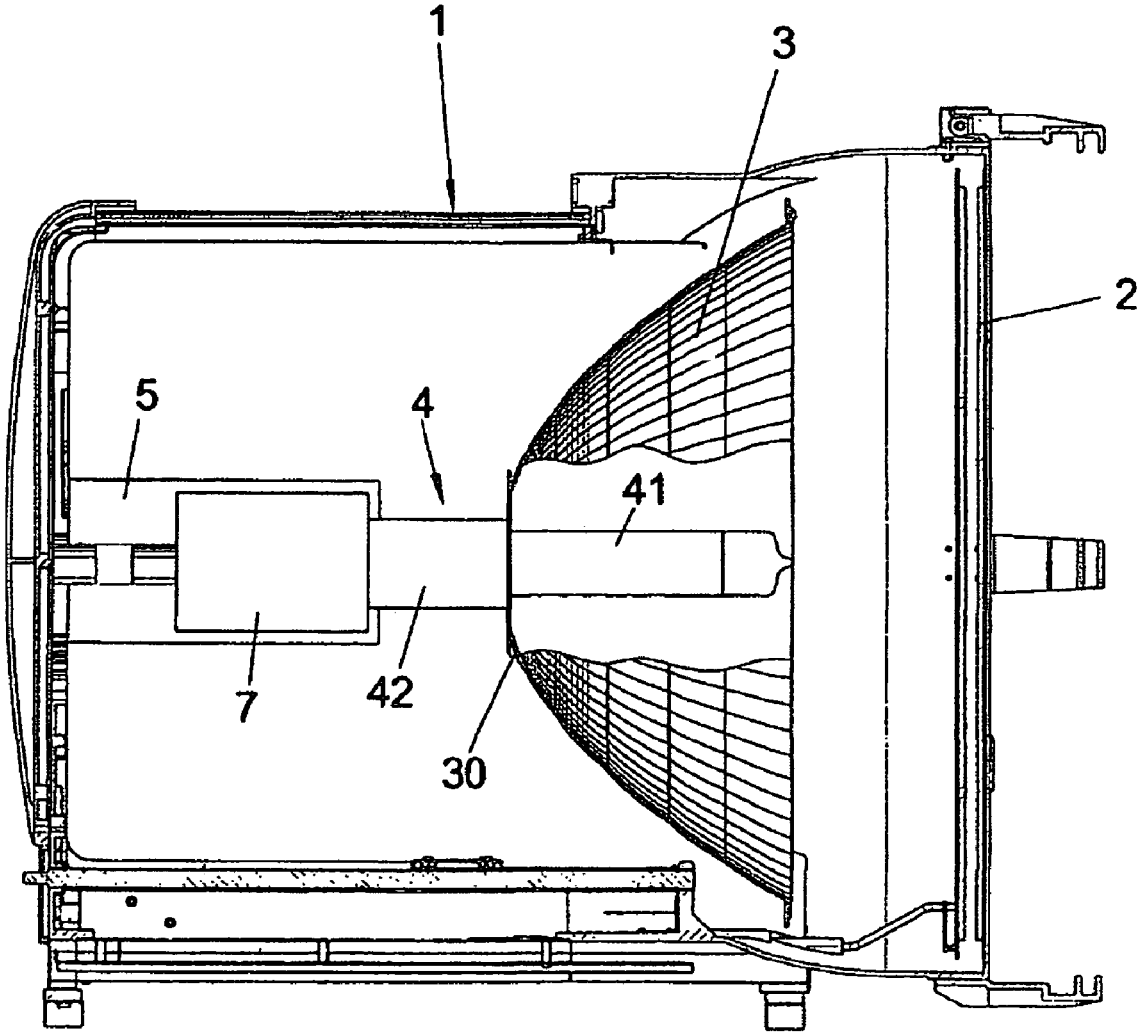
FIG. 1 shows a section through a spotlight for film, studio, stage and event lighting.

FIG. 1 shows a longitudinal section through a spotlight housing 1 of a spotlight for film, studio, stage and event lighting with a covering element 2, which terminates the light-emitting front side of the spotlight housing 1, in the form of a glass disk or a lens disk and holding claws for accommodating attachment elements such as diffusers, filter disks, protective disks and the like. A luminous means housing 5 for accommodating a luminous means 4 in the form of a lamp or a light and a reflector 3 are arranged in the spotlight housing 1, which reflector 3 reflects the light emitted by the luminous means 4 in the direction of the front covering element 2 and has an opening 30, through which the luminous means 4 is plugged.

The luminous means housing 5 contains a luminous means holder 7 with plug-type sockets for the supply of power, into which plug-type sockets the contact pins of the luminous means 4 are inserted, which luminous means 4 has an elongate, gas-filled glass body 41 and a luminous means base 42 with the contact pins.

Figure 2:
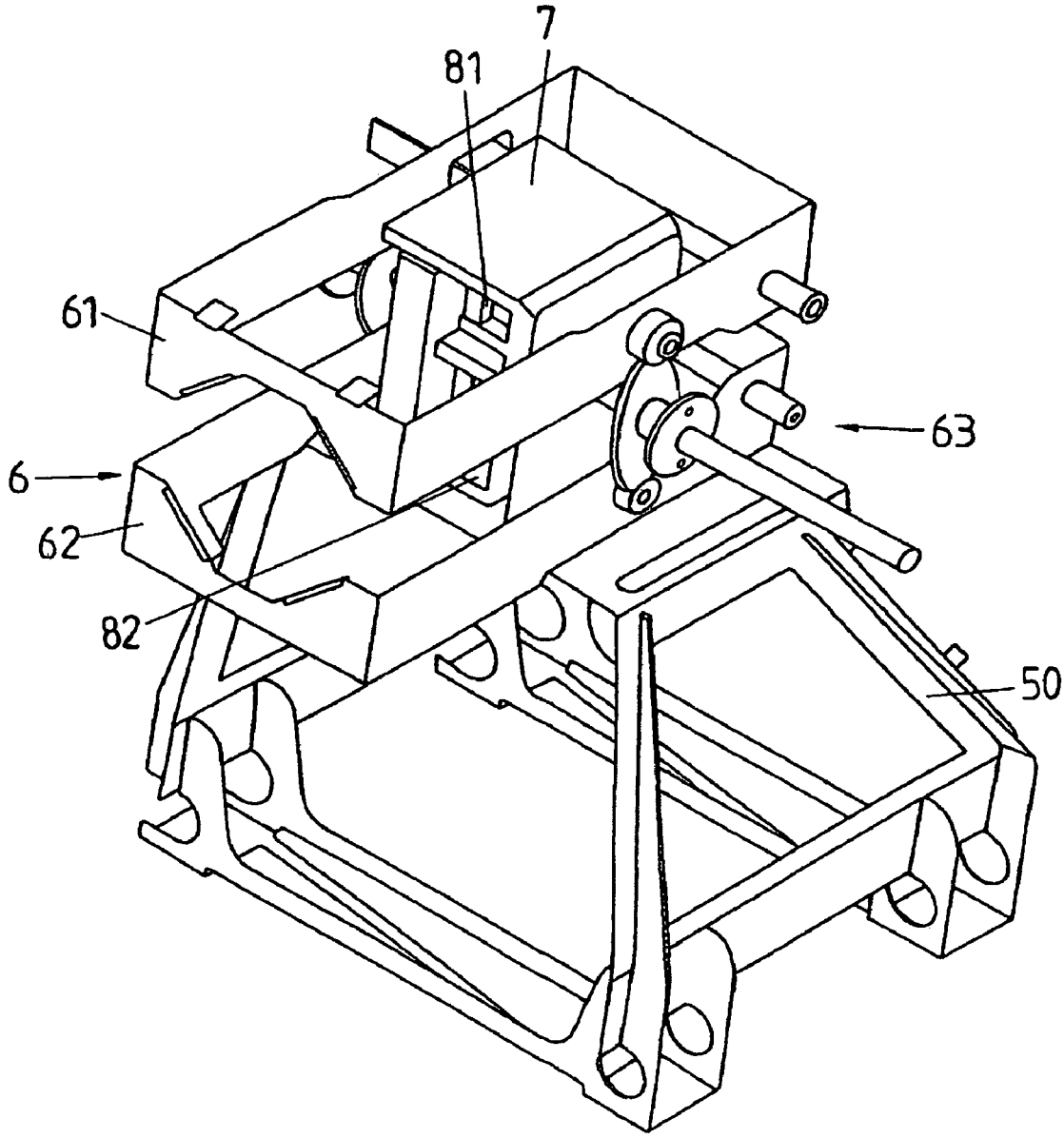
FIG. 2 shows a schematic/perspective illustration of an accommodating apparatus for a luminous means with a clamping apparatus supporting the luminous means base and plug-type sockets for accommodating the contact pins of the luminous means.

FIG. 2 shows, in a schematic/perspective view, a holder mount 50, which is connected to the luminous means housing via a spring-elastic bearing and accommodates the luminous means holder 7 with the plug-type sockets 81, 82 for the supply of power, into which plug-type sockets the contact pins of the luminous means, in particular of a discharge lamp 4 with a base at one end as in FIG. 1, are inserted.

In order to reduce or eliminate the forces acting on the contact pins as a result of the length of the glass body 41 and its weight and the weight of the luminous means base 42 on the contact pins of the luminous means, which forces are transmitted to the luminous means interior and there result in impermissible voltages and failure of the luminous means and can impair the electrical contact between the contact pins and the plug-type sockets 81, 82 of the luminous means holder 7, and in order to improve the holding and clamping of the luminous means 4, a clamping apparatus 6 with two clamping jaws 61, 62 is provided, which clamping jaws surround the luminous means base axially with respect to one another at a distance and clamp it in a force-fitting and/or form-fitting manner. The upper clamping jaw 61 and the lower clamping jaw 62 are each connected to two lever arms, which are connected to one another at their ends opposite the clamping jaws 61, 62 via transverse webs and bear flat against the luminous means holder 7. Connecting rods are provided parallel to the transverse webs between the lever arms of the upper and lower clamping jaws 61, 62, which connecting rods are connected to the holder mount 5 via spring-elastic supports.

As a result of the sprung mounting of the lever arms and therefore of the clamping jaws 61, 62, in the event of a movement of the luminous means 4 brought about, for example, by impacts, the accommodating apparatus moves along in the same plane, with the result that the contact pins remain free of stresses. As a result of a likewise elastic support of the luminous means holder 7 via spring-mounting with respect to the holder mount 5, it is ensured that no forces are transmitted to the contact pins of the luminous means 4, with the result that the contact pins are used exclusively for transmitting the electrical power.

An adjusting device 63 with an adjusting element acting on the lever arms and an actuating element for manually actuating the adjusting device 63 is used for adjusting the clamping jaws 61, 62 from an opening position, in which the luminous means base 42 is released for removal of the luminous means 4, into a closing and/or locking position, in which the clamping jaws 61, 62 clamp in the luminous means base 42 and fix the luminous means 4 in its position.

In order to insert or replace a luminous means, the clamping jaws 61, 62 are opened by means of the adjusting device 63 and the luminous means 4 is inserted through the trapezoidal opening of the clamping jaws 61, 62, which are separated from one another from the front side of the spotlight, with its luminous means base 42 into the luminous means holder 7 and in the process the contact pins of the luminous means 4 are inserted into the plug-type sockets 81, 82 of the luminous means holder 7. However, only when the luminous means base 42 has been inserted into the luminous means holder 7 straight is firstly a central arrangement of the luminous means 4 in the luminous means holder 7 between the clamping jaws 61, 62 of the clamping apparatus 6 and secondly optimum electrical contact between the contact pins of the luminous means 4 and the plug-type sockets 81, 82 of the luminous means holder 7 ensured so as to avoid damage as a result of breakage, electrical flashovers or contact corrosion.

Figure 8:
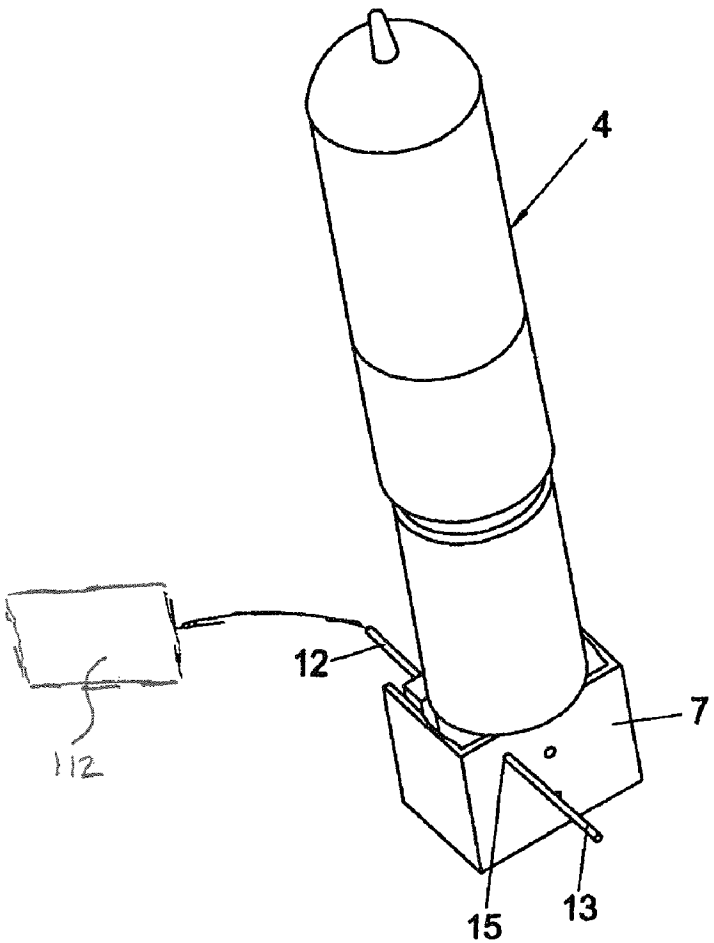
FIG. 8 shows a schematic/perspective illustration of an optical position detection device with fiberoptic conductors adhesively bonded into openings of the luminous means holder after the insertion of a luminous means into a luminous means holder.
Figure 9:
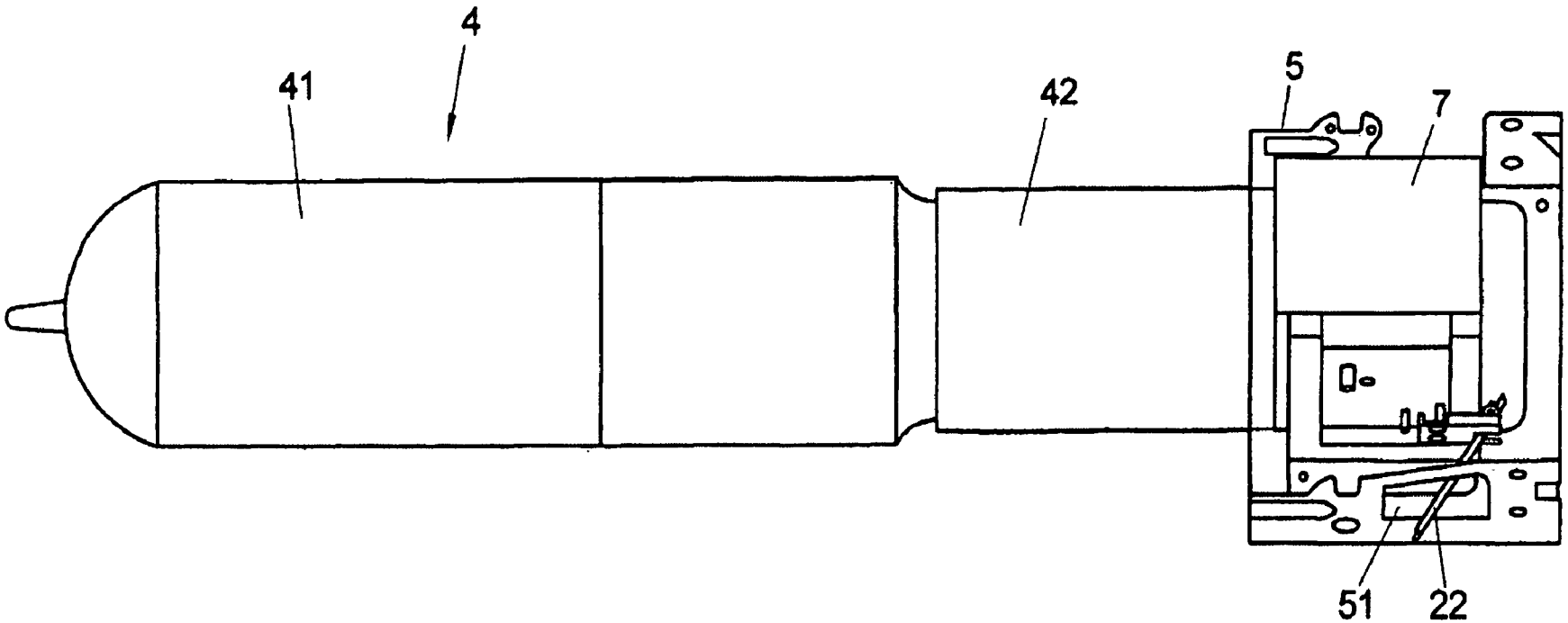
FIG. 9 shows a schematic/perspective illustration of a first variant of a mechanical position detection device with luminous means inserted into a luminous means holder.
Figure 10:
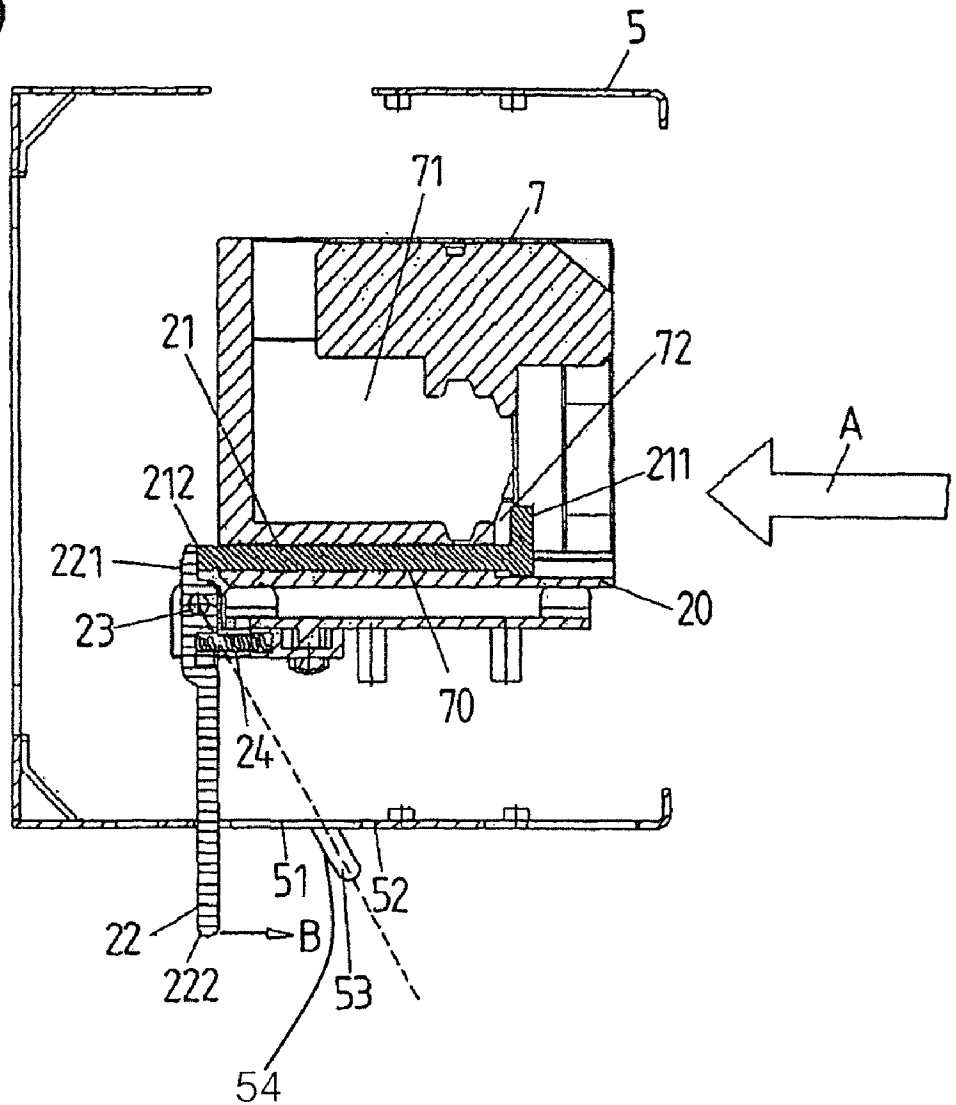
FIG. 10 shows a section through the luminous means housing and the luminous means holder shown in FIG. 9.

In order to ensure a correct fit of the luminous means 4 and therefore optimum alignment of the luminous means base 42 with respect to the luminous means holder 7, a monitoring device is provided in accordance with the invention which can be designed, corresponding to the schematic/perspective illustrations in FIGS. 3 to 8, as an optical position detection device and, in accordance with FIGS. 9 and 10, as a mechanical position detection device and, in an embodiment which is not illustrated in any more detail, as an inductive, capacitive or resistive position detection device.

FIGS. 3 to 8 show three different variants of an optical position detection device prior to the insertion of a luminous means 4 in the form of a lamp with a base at one end and with the luminous means 4 inserted.

Figure 3:
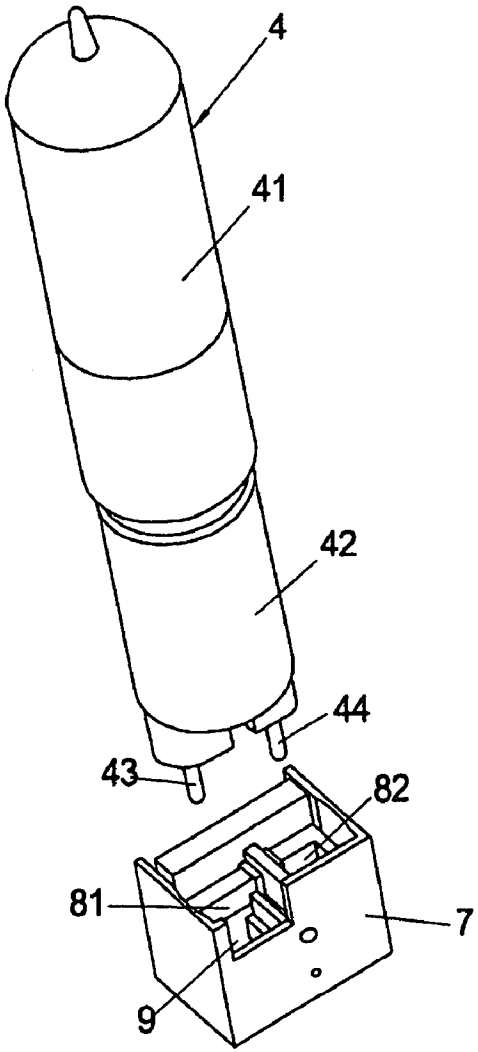
FIG. 3 shows a schematic/perspective illustration of an optical position detection device with an inspection opening in the luminous means holder prior to insertion of a luminous means into the luminous means holder.

FIG. 3 shows, in a schematic/perspective illustration, a luminous means 4 with a gas-filled glass body 41, a luminous means base 42 and two contact pins 43, 44, which are inserted into plug-type sockets 81, 82 of a luminous means holder 7 for the purpose of making electrical contact. For the optical control of the correct fit of the luminous means 4 and therefore the luminous means base 42 or the contact pins 43, 44 in the luminous means holder 7 or the plug-type sockets 81, 82, an optical positioning device in the form of an inspection opening is provided in a side wall of the luminous means housing 5 and/or spotlight housing 1 and a cutout 9 is provided in the luminous means holder 7, via which device a lateral observation of the connection between the luminous means base 42 and the luminous means holder 7 is possible. In order to be able to see the viewing field to be checked to a sufficient extent, the inspection opening in the spotlight or luminous means housing or the cutout 9 in the luminous means holder 7 needs to be designed to be sufficiently large.

Figure 4:
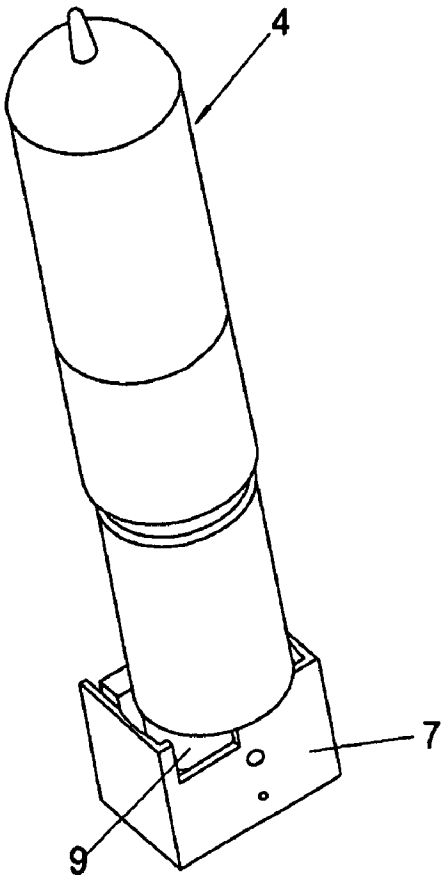
FIG. 4 shows a schematic/perspective illustration of an optical position detection device with an inspection opening in the luminous means holder after insertion of a luminous means into the luminous means holder.

FIG. 4 shows, with the luminous means 4 inserted into the luminous means holder 7, the viewing field which is directed towards the connection between the luminous means base 42 and the insertion opening of the luminous means holder 7 and is made possible by the cutout 9, which is arranged on the front edge, in the insertion direction of the luminous means 4 into the luminous means holder 7.

Figure 6:
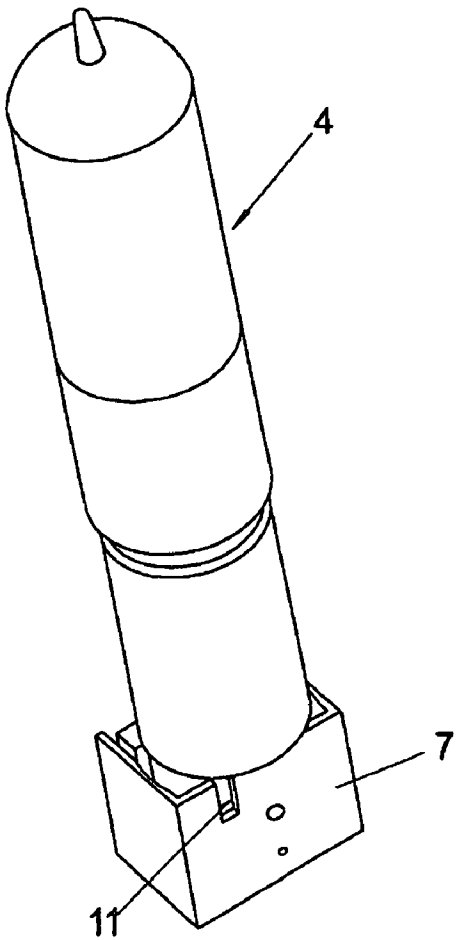
FIG. 6 shows a schematic/perspective illustration of an optical position detection device with a broken-away luminous means holder for transillumination after the insertion of a luminous means into the luminous means holder.
Figure 5:
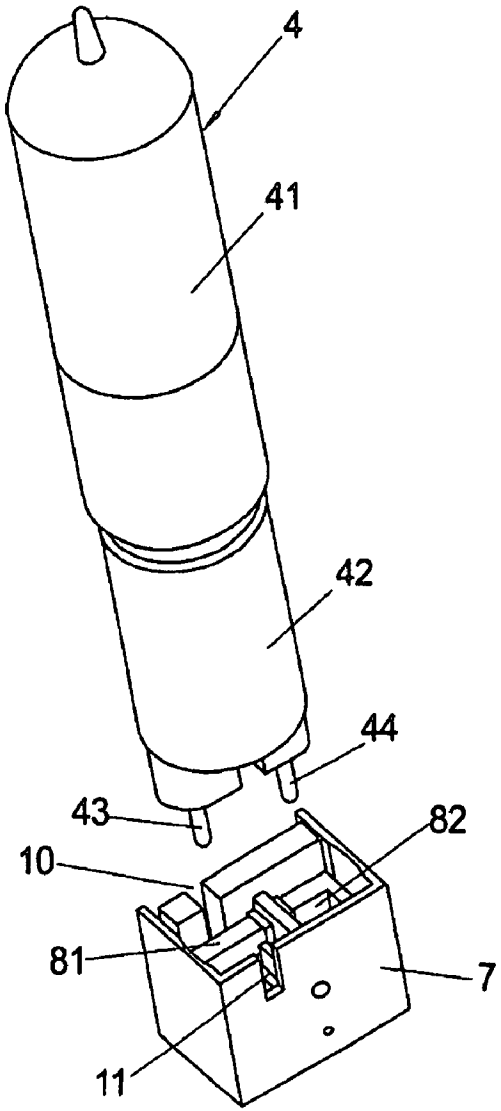
FIG. 5 shows a schematic/perspective illustration of an optical position detection device with a broken-away luminous means holder for transillumination prior to the insertion of a luminous means into the luminous means holder.

Since this inspection opening in the luminous means or spotlight housing which is large enough to ensure a sufficient viewing field for controlling the connection of the luminous means base to the luminous means holder is problematic in terms of the parasitic light occurring, the ingress of spraywater, the influencing of the convection cooling and the electrical insulation of the live parts of the luminous means and the luminous means holder, as an alternative FIGS. 5 and 6 illustrate an optical positioning device in which, instead of a relatively large inspection opening, two mutually opposite openings or cutouts 10, 11 are provided in the luminous means holder 7 and therefore aligned in the luminous means housing 5.

The two cutouts or openings 10, 11 are arranged in the side walls of the luminous means holder 7 and the luminous means housing 5, respectively, with the result that, when the luminous means 4 is inserted into the luminous means holder 7, lateral viewing is sufficient in which the cutout or opening 10 or 11, which is arranged on the side opposite the viewer, is used for the supply of light and the cutout or opening 11 or 10 which faces the viewer is used as the control opening or control cutout. The light path formed between the cutouts or openings 10, 11 forms an optical positioning device in the manner of a light barrier which is interrupted in the event of correct insertion of the luminous means 4 into the luminous means holder 7 and as a result indicates the correct fit of the luminous means base 42 in the luminous means holder 7 to the operator and therefore gives the operator a control option as early as when the luminous means 4 is positioned onto the luminous means holder 7.

Since in this embodiment as well, despite the cross section of the cutouts or openings 10, 11 which is markedly reduced in comparison with the inspection opening 9 in the embodiment shown in FIGS. 3 and 4, problems occur, even if to a reduced extent, in terms of light shielding, influencing of the convection cooling, restriction of the protection against spraywater and jet-water and with respect to electrical insulation problems.

Figure 7:
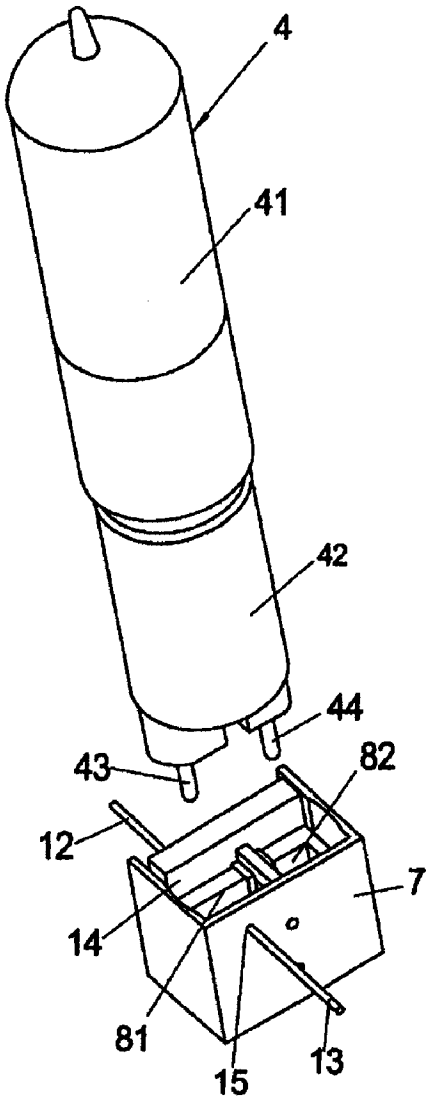
FIG. 7 shows a schematic/perspective illustration of an optical position detection device with fiberoptic conductors adhesively bonded into openings of the luminous means holder prior to the insertion of a luminous means into a luminous means holder.

These problems are eliminated in the embodiment of an optical positioning device illustrated in FIGS. 7 and 8 in which fiberoptic conductors 12, 13 are adhesively bonded into openings 14, 15 of the luminous means holder 7. The fiberoptic conductors 12, 13, which are made from glass or glass ceramic, are guided to side walls of the spotlight housing and serve the purpose firstly of supplying light and secondly of controlling positioning by virtue of the light which is injected into the luminous means holder 7 via one fiberoptic conductor 12 or 13 hitting the opposite fiberoptic conductor 12 or 13 via the mutually aligned openings 14, 15 either in interrupted fashion when there is a correct fit or when the luminous means 4 has not been inserted into the luminous means holder 7 correctly.

The fiberoptic conductor 12 or 13 which is not used for injecting the light is connected to an opening or an optical element in the spotlight housing or to an optoelectrical transducer or an acoustic signal device, as for example an optoelectrical transducer or acoustic signal 112 device in the case where fiberoptic conductor 12 is not used for injecting light and allows for a direct visual control by the operator or acoustic and/or optical signaling when the luminous means 4 is correctly or incorrectly inserted into the luminous means holder 7. When the luminous means 4 is correctly inserted into the luminous means holder 7, no light is output via the fiberoptic conductor 12 or 13 which is not used for the light injection, with the result that the clamping apparatus 6 shown in FIG. 2 can be connected to the mechanical safety means of the luminous means 4 and the spotlight can be brought into operation.

The embodiment illustrated in FIGS. 7 and 8 prior to the insertion of the luminous means 4 into the luminous means holder 7 or when the luminous means 4 is inserted into the luminous means holder 7 eliminates the problems as regards the light shielding, the influencing of the convection cooling, the restriction of the protection against spraywater and jetwater and the electrical insulation, but requires additional complexity in terms of optical and electronic components.

FIGS. 9 and 10 illustrate a first embodiment of a mechanical position detection device which, in comparison with the optical position detection devices, makes correct insertion of a luminous means into a luminous means holder of a spotlight possible even under poor visual conditions or in complete darkness and can be realized using simple and cost-effective means.

The mechanical position detection device, as shown in the schematic/perspective illustration in FIG. 9 and the sectional illustration in FIG. 10, comprises a mechanical sensor in the form of a feeler 21, which is inserted into a longitudinal bore 70 of the luminous means holder 7 and has a hook-shaped projection 211, which is arranged at the front end, in the insertion direction A of the luminous means, of the luminous means holder 7 and protrudes into the insertion opening toward the chamber 71 for accommodating the electrical contacts of the plug-type sockets. The contact pin 21 has, at its opposite end, a stop 212, which bears against a stop face of a first lever arm 221 of an indicator lever 22, which is supported in such a way that it can rotate about a bearing 23 in a position detection housing 20. A second lever arm 222, which emerges from the bearing 23, of the indicator lever 22 protrudes through a cut-out portion 51 of the luminous means housing 5 and is supported on a spring 24, which is arranged in a recess of the housing 20.

When a luminous means is inserted into the luminous means holder 7, the feeler 21 is displaced in the insertion direction A into a cutout 72 in the chamber 71 of the luminous means holder 7 and at the same time deflects the indicator lever 22 counter to the effect of the spring 24 in the direction of the arrow B indicated on the indicator lever 22. In the case of a correct fit of the luminous means in the luminous means holder 7, the indicator lever 22 bears against an end stop 52 of the cutout 51 or coincides with a marking which is integrally formed on the luminous means housing 5 and signals to the operator the correct fit of the luminous means or the luminous means base in the luminous means holder 7. The marking 54 which is integrally formed on the luminous means housing 5 preferably comprises a tab 53, which corresponds to the contour of the end of the indicator lever 22 and is aligned with the direction of the deflection of the indicator lever 22 when the luminous means base and therefore the luminous means is inserted completely into the luminous means holder 7, with the result that both a deviation from and reaching of the correct fit of the luminous means in the luminous means holder 7 can be detected without any visual control.

In the embodiment illustrated in FIGS. 9 and 10 of a mechanical position detection device, the luminous means holder is made from a ceramic material and the feeler 21, which is mounted in the bore 70 in such a way that it is longitudinally displaceable in the insertion direction A, is made from ceramic, glass ceramic or glass for reasons of electrical insulation and resistance to high temperatures. As a result, the insulating effect of the luminous means holder 7 and the necessary leakage paths and air gaps are maintained since the part of the mechanical position detection device which is in the region at risk is made from a high-temperature insulator.

As a result of the lever transmission of the indicator lever 22, whose first lever arm 221 is substantially shorter than the second lever arm 222, the longitudinal displacement of the feeler 21 with a large transmission results in a precise stop of the luminous means in the luminous means holder 7 being indicated.

In a further-reaching embodiment, the mechanical position detection device illustrated in FIGS. 9 and 10 can be coupled to a mechanism which prevents the clamping apparatus 6 shown in FIG. 2 from closing or prevents the supply of power to the luminous means holder 7 as long as the luminous means is not inserted correctly into the luminous means holder 7.

Figure 11:
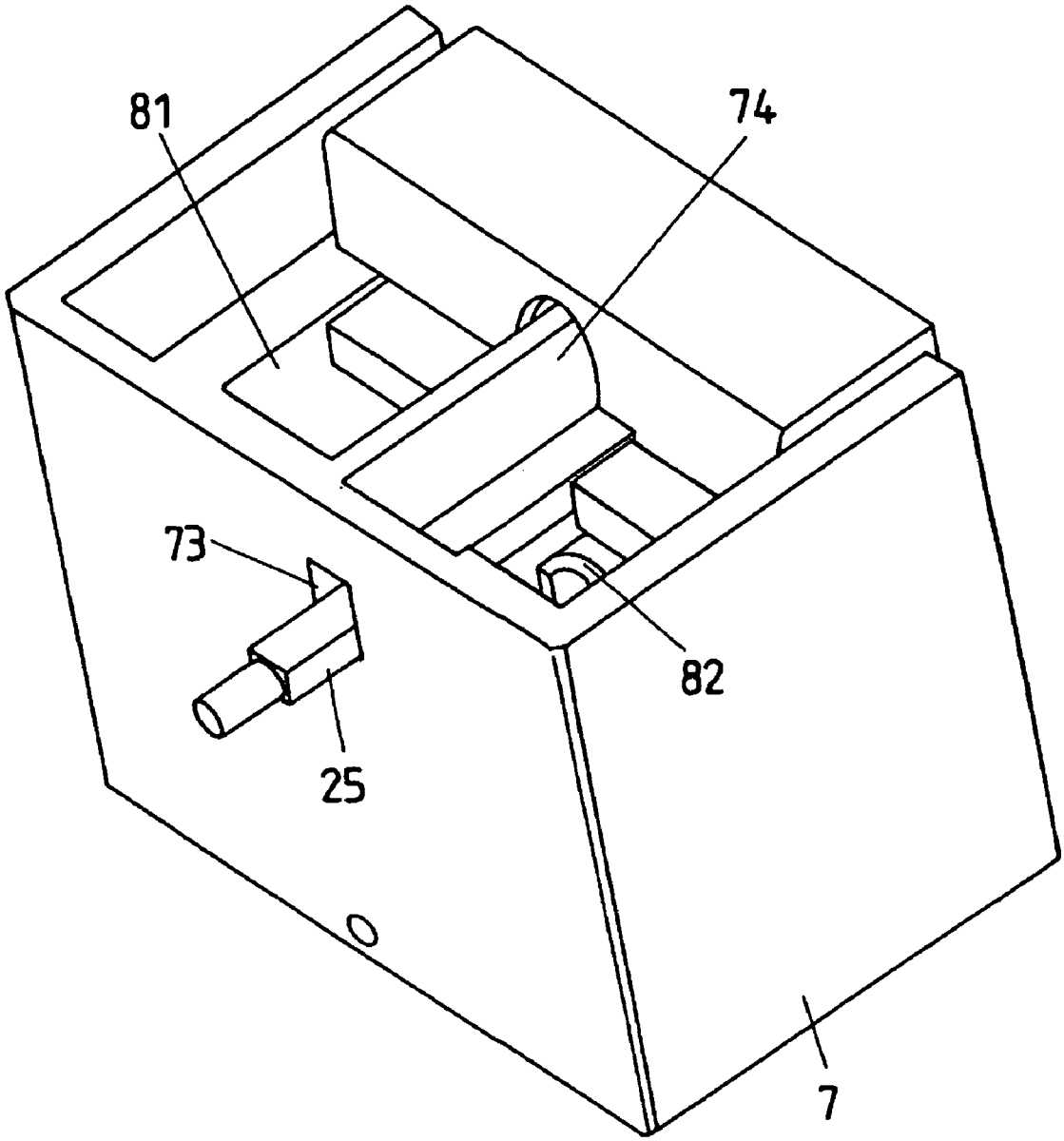
FIG. 11 shows a schematic/perspective illustration of a luminous means holder with a feeler which is mounted in freely floating fashion and is in the form of a ceramic lever.
Figure 12:
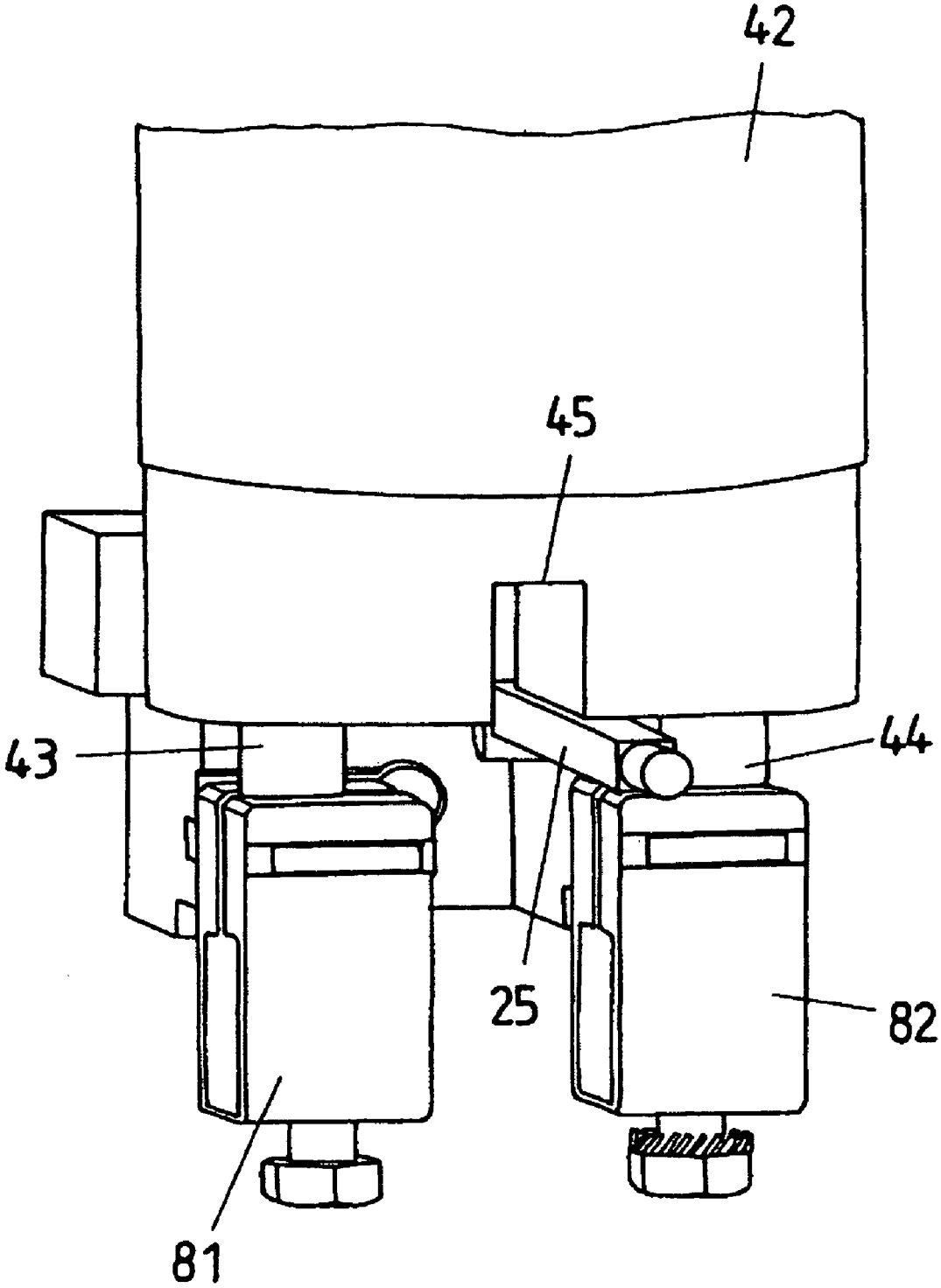
FIG. 12 shows a schematic/perspective side view of the position of a ceramic lever when the contact pins of a luminous means base are inserted into the plug-type sockets of a luminous means holder.
Figure 13:
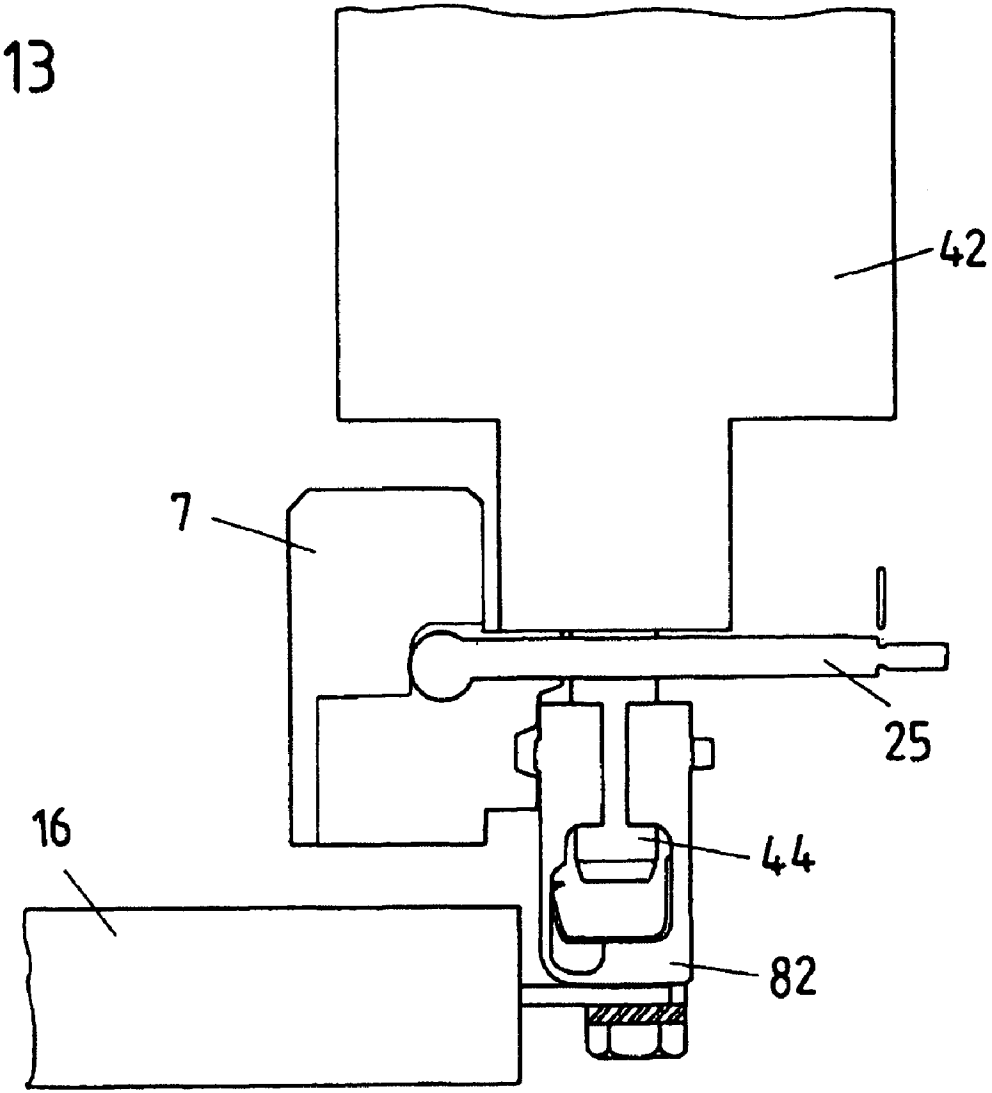
FIG. 13 shows a partially sectioned side view given the positioning of the luminous means base in the luminous means holder shown in FIG. 12.

The second embodiment illustrated in FIGS. 11 to 13 of a mechanical position detection device contains a ceramic lever 25, which is mounted in freely floating fashion in the luminous means holder, in particular with a square cross section. The ceramic lever 25 protrudes through a cutout 73, which is in the form of a rectangular slot, out of the luminous means holder 7 and is arranged in such a way that it is laterally offset with respect to a web 74, which corresponds to a cutout 45 at the lower end of the luminous means base 42 and separates the plug-type sockets 81, 82, which are connected to a cable 16 for power supply purposes and accommodate the contact pins 43, 44 at the lower end of the luminous means base 42. That end of the ceramic lever 25, which is mounted in freely floating fashion, which protrudes through the cutout 73 out of the luminous means holder 7 has a cylindrical end, which is connected in a suitable manner to an indicator lever, which is guided toward the outer side of the luminous means housing (not illustrated in any more detail).

The solution according to the invention can additionally be associated with an electrical signal device with, for example, an inductive-electronic, capacitive-electronic or resistive-electronic transducer, which signal device closes a monitoring path when the luminous means holder is correctly inserted into the luminous means holder and emits a signal for further evaluation to an optical or acoustic display or for example to a device for blocking a clamping device, which can be connected in a force-fitting and/or form-fitting manner to the luminous means base, and/or a device for interrupting the power supply to the plug-type sockets of the luminous means holder when there is no fit of the luminous means in the luminous means holder.

The invention claimed is:

1. An apparatus for accommodating and making electrical contact with a luminous means, which includes a glass vessel, a luminous means base and contact pins at the luminous means base for supplying power, in a spotlight, which includes a luminous means holder for accommodating the luminous means base with plug-type sockets for accommodating the contact pins of the luminous means, which luminous means holder has a monitoring device for monitoring or allowing for the monitoring of a connection between the luminous means base and the luminous means holder, said monitoring device being an optical position inspection device with at least one inspection opening, which is arranged on a side wall of the spotlight housing and/or a luminous means housing in a region of the luminous means holder and is aligned with at least one opening or cutout of the luminous means holder for monitoring the relative position of at least one part of the luminous means base in relation to the luminous means holder when the luminous means base is inserted into the luminous means holder.

2. The apparatus of claim 1, wherein the opening or cutout of the luminous means holder is arranged in a contact region of the end side of the luminous means base with the luminous means holder.

3. The apparatus of claim 1, wherein the opening or cutout of the luminous means holder is arranged on a front edge, in an insertion direction of the luminous means, of the luminous means holder.

4. The apparatus of claim 1, wherein the optical position detection device contains two inspection openings, which are positioned opposite one another, are arranged on side walls of the spotlight housing and/or of the luminous means housing in a region of the luminous means holder and are aligned with mutually opposite openings or cutouts of said at least one opening or cutout of the luminous means holder.

5. The apparatus of claim 4, wherein the two mutually opposite openings are arranged in the luminous means holder in a contact region of an end side of the luminous means base with the luminous means holder.

6. The apparatus of claim 1, wherein said at least one opening or cutout comprises two mutually opposite openings wherein the optical position detection device has at least one fiberoptic conductor which is connected to one of the two mutually opposite openings in the luminous means holder and to a display element.

7. The apparatus of claim 6, wherein an opening of said two openings opposite the one to which the fiberoptic conductor is connected to supplies light to a contact region.

8. The apparatus of claim 7, wherein the opening or cutout allows for supplying light to the contact region or the fiberoptic conductor supplying light to the contact region is connected to a light-injecting opening or optical element in the spotlight housing.

9. The apparatus of claim 6, wherein the monitoring device comprises said at least one inspection opening or viewing optical element arranged on the spotlight housing.

10. The apparatus of claim 7, wherein the light-injecting opening or cutout or the light-supplying fiberoptic conductor is connected to an auxiliary lamp for illuminating or transilluminating the relevant part of the luminous means holder.

11. The apparatus of claim 6, wherein the monitoring device comprises an optoelectronic transducer, which is connected to the spotlight housing, and an optical and/or acoustic signal device.

12. The apparatus of claim 6, wherein at least one fiberoptic conductor comprises a glass or glass-ceramic fiberoptic conductor.

13. The apparatus of claim 1, wherein the luminous means holder is made from ceramic, glass ceramic or glass.

14. An apparatus for accommodating and making electrical contact with a luminous means, which includes a glass vessel, a luminous means base and contact pins at the luminous means base for supplying power, in a spotlight, which includes a luminous means holder for accommodating the luminous means base with plug-type sockets for accommodating the contact pins of the luminous means, which luminous means holder has a monitoring device for monitoring or allowing for the monitoring of a connection between the luminous means base and the luminous means holder, said monitoring device being a mechanical position detection device with a mechanical sensor, which is inserted into the luminous means holder and is connected to a display device, said mechanical sensor comprising a feeler which protrudes into the luminous means holder, can be displaced when the luminous means base is inserted into the luminous means holder and is connected to an indicator lever.

15. The apparatus of claim 14, wherein the feeler is guided toward an end of the luminous means holder which is opposite an insertion opening of the luminous means holder and bears against a first lever aim of a rotatably mounted and spring-loaded indicator lever, wherein a second lever aim of said indicator lever is guided through a cut-out portion of a holder mount which accommodates the luminous means holder and/or of a luminous means housing.

16. The apparatus of claim 15, wherein the second lever arm is longer than the first lever arm.

17. The apparatus of claim 14, wherein the second lever arm of the indicator lever is arranged in a molded part of a holder mount or the luminous means housing, which molded part has a marking which is correlated with a displacement of the feeler when the luminous means base is inserted into the luminous means holder.

18. The apparatus of claim 17, wherein the marking comprises an end stop of a cutout, which accommodates the second lever aim of the indicator lever.

19. The apparatus of claim 17, wherein the marking comprises a tab which corresponds to a contour of an end of the indicator lever and is aligned with a direction of the deflection of the indicator lever when the luminous means base is completely inserted into the luminous means holder.

20. The apparatus of claim 19, wherein the feeler has a hook-shaped or mushroom-shaped projection, which protrudes into the insertion opening of the luminous means holder and can be displaced into a cutout of the luminous means holder when the luminous means base is inserted into the luminous means holder.

21. The apparatus of claim 19, wherein the feeler is made from ceramic, glass ceramic or glass.

22. The apparatus of claim 14, wherein an end of the feeler which protrudes into the insertion opening of the luminous means holder is designed in such a way that, when the luminous means base is inserted into the luminous means holder, it stops against part of the luminous means holder.

23. The apparatus of claim 22, wherein the area of that end of the feeler which protrudes into the insertion opening of the luminous means holder is greater than the diameter of the feeler.

24. The apparatus of claim 14, wherein the feeler comprises a ceramic lever, which is mounted in freely floating fashion in the luminous means housing and/or the luminous means holder and is guided in at least one cutout of the luminous means housing and/or the luminous means holder.

25. The apparatus of claim 24, wherein the ceramic lever is connected to an indicator lever, which is arranged outside the luminous means housing and/or the luminous means holder.

26. An apparatus for accommodating and making electrical contact with a luminous means, which includes a glass vessel, a luminous means base and contact pins for supplying power, in a spotlight, which includes a luminous means holder for accommodating the luminous means base with plug-type sockets for accommodating the contact pins of the luminous means, which luminous means holder has a monitoring device for monitoring or allowing for the monitoring of a connection between the luminous means base and the luminous means holder, and a feeler which protrudes into the luminous means holder, can be displaced when the luminous means base is inserted into the luminous means holder and is connected to an indicator lever wherein the monitoring device comprises a device for detecting the relative position of at least one part of the luminous means base in relation to the luminous means holder when the luminous means base is inserted into the luminous holder.

27. The apparatus of claim 26, wherein the feeler is guided toward an end of the luminous means holder which is opposite an insertion opening of the luminous means holder and bears against a first lever arm of a rotatably mounted and spring-loaded indicator lever, wherein a second lever arm of said indicator lever is guided through a cut-out portion of a holder mount which accommodates the luminous means holder and/or of a luminous means housing.

28. The apparatus of claim 27, wherein the second lever arm is longer than the first lever arm.

29. The apparatus of claim 26, wherein the second lever arm of the indicator lever is arranged in a molded part of a holder mount or the luminous means housing, which molded part has a marking which is correlated with a displacement of the feeler when the luminous means base is inserted into the luminous means holder.

30. The apparatus of claim 29, wherein the marking comprises an end stop of a cutout, which accommodates the second lever arm of the indicator lever.

31. The apparatus of claim 29, wherein the marking comprises a tab which corresponds to a contour of an end of the indicator lever and is aligned with a direction of the deflection of the indicator lever when the luminous means base is completely inserted into the luminous means holder.

32. The apparatus of claim 31, wherein the feeler has a hook-shaped or mushroom-shaped projection, which protrudes into the insertion opening of the luminous means holder and can be displaced into a cutout of the luminous means holder when the luminous means base is inserted into the luminous means holder.

33. The apparatus of claim 31, wherein the feeler is made from ceramic, glass ceramic or glass.

34. The apparatus of claim 26, wherein an end of the feeler which protrudes into the insertion opening of the luminous means holder is designed in such a way that, when the luminous means base is inserted into the luminous means holder, it stops against part of the luminous means holder.

35. The apparatus of claim 34, wherein the area of that end of the feeler which protrudes into the insertion opening of the luminous means holder is greater than the diameter of the feeler.

36. The apparatus of claim 26, wherein the feeler comprises a ceramic lever, which is mounted in freely floating fashion in the luminous means housing and/or the luminous means holder and is guided in at least one cutout of the luminous means housing and/or the luminous means holder.

37. The apparatus of claim 36, wherein the ceramic lever is connected to an indicator lever, which is arranged outside the luminous means housing and/or the luminous means holder.

38. An apparatus for accommodating and making electrical contact with a luminous means, which includes a glass vessel, a luminous means base and contact pins for supplying power, in a spotlight, which includes a luminous means holder for accommodating the luminous means base with plug-type sockets for accommodating the contact pins of the luminous means, which luminous means holder has a monitoring device for monitoring or allowing for the monitoring of a connection between the luminous means base and the luminous means holder, wherein the monitoring device comprises a device for detecting the relative position of at least one part of the luminous means base in relation to the luminous means holder when the luminous means base is inserted into the luminous holder, wherein said monitoring device is an optical position inspection device with at least one inspection opening, which is arranged on a side wall of the spotlight housing and/or a luminous means housing in a region of the luminous means holder and is aligned with at least one opening or cutout of the luminous means holder, wherein said at least one opening or cutout comprises two mutually opposite openings wherein the optical position detection device has at least one fiberoptic conductor which is connected to one of the two mutually opposite openings in the luminous means holder and to a display element.

* * * * *

UNITED STATES PATENT AND TRADEMARK OFFICE

CERTIFICATE OF CORRECTION

PATENT NO. : 7,867,018 B2
APPLICATION NO. : 12/085881
DATED : January 11, 2011
INVENTOR(S) : Harald Krieg et al.

It is certified that error appears in the above-identified patent and that said Letters Patent is hereby corrected as shown below:

In the Claims

| | |
|---|---|
| Column 14, Claim 15, line 31 | Delete “aim” Insert -- arm -- |
| Column 14, Claim 15, line 32 | Delete “aim” Insert -- arm -- |
| Column 14, Claim 18, line 46 | Delete “aim” Insert -- arm -- |

Signed and Sealed this
Sixth Day of September, 2011

David J. Kappos

David J. Kappos
*Director of the United States Patent and Trademark Office*